United States Patent [19]

Jones

[11] 3,980,266

[45] Sept. 14, 1976

[54] DESK TOP WORK SUPPORT DEVICE

[76] Inventor: Robert E. Jones, 4818 Marathon Drive, Madison, Wis. 53705

[22] Filed: Dec. 26, 1974

[21] Appl. No.: 536,610

[52] U.S. Cl. ..... 248/454; 248/460; 312/233

[51] Int. Cl.[2] ..... A47G 1/24

[58] Field of Search ..... 248/454, 455, 457, 460, 248/461, 462, 463, 281; 312/231, 233; 108/1, 9; 45/131

[56] References Cited

UNITED STATES PATENTS

| | | | |
|---|---|---|---|
| 928,614 | 7/1909 | Mohr | 312/231 |
| 1,301,406 | 4/1919 | Dierks | 248/454 |
| 1,343,527 | 6/1920 | Stoelzel | 248/454 |
| 1,420,439 | 6/1922 | Moore | 248/454 |
| 1,836,466 | 12/1931 | Hamilton | 312/233 |
| 1,847,195 | 3/1932 | Robinson | 248/454 |
| 3,057,112 | 10/1962 | Bergman | 45/131 |

FOREIGN PATENTS OR APPLICATIONS

| | | | |
|---|---|---|---|
| 166,161 | 3/1934 | Switzerland | 248/461 |
| 368,897 | 3/1932 | United Kingdom | 312/233 |

*Primary Examiner*—Robert A. Hafer
*Attorney, Agent, or Firm*—Theodore J. Long; John M. Winter; Harry C. Engstrom

[57] ABSTRACT

A desk top work support device having a base with an inclined primary work surface, and having a secondary work support member positioned above the primary work surface. The secondary work support member is pivotally mounted on the base to provide a preset forward position for close reading, and a preset rearward position for secondary reference tasks wherein the secondary work support member does not interfere with access to the primary work surface. The pivoting linkage provides different inclinations for the secondary work support member with respect to the primary work surface in said forward and rearward positions to permit optimum utilization of remote light sources. The secondary work support member has a support bar, and removable work holders which may be slidably engaged within the base and are retained therein by the secondary work support bar when it is in its rearward position.

8 Claims, 7 Drawing Figures

DESK TOP WORK SUPPORT DEVICE

BACKGROUND OF THE INVENTION

1. Field of the Invention

This invention relates generally to improved environmental design of work surfaces utilized for desk work and more particularly of a desk top work support device for sustained combination reading and writing tasks.

2. Description of the Prior Art

Sustained close visually-centered tasks such as reading and writing separately and in combination result in certain interactions between the work support mechanisms, the body support mechanisms, and the human organism. To understand these relationships a dynamic/adaptive concept of posture and vision is necessary as developed by Harmon, Darell Boyd, *Notes on a dynamic theory of vision*, 3d revision, Austin, Texas, The Author, 1958; *The coordinated classroom;* Grand Rapids, Mich. American Seating Co. 1951, and articulated further by Moran, Walter J., *The design of a basic home study unit,* Term paper for Environmental Design 801, Madison, University of Wisconsin, 1969. This concept states, briefly, that the body tends to grow or adapt along lines of stress. The body and especially the torso will reflexively position itself so that an object to be viewed is essentially perpendicular to the observer's line of sight. For a close visual or eye motor task as might be ordinarily performed when using a flat desk and a chair, a person must hunch over the table to obtain adequate visual contact. The short term effects of this hunching are a sacrifice of comfort and premature fatigue and/or restlessness. The longer term effects are the result of postural accomodations which typically exceed the normal limits of human adaptation and lead to a series of problems, important among which are the inability to characteristically stand erect, concomitant vision problems, and finally a progression of osteo arthritis of the neck and/or lower back.

These conditions can be minimized or perhaps even prevented by adequate work environment design. For sustained combination reading and writing tasks such an adequate work environment design includes a secondary work support member for predominantly reading tasks placed in relative close proximity, typically about 16 inches, to the user at an inclination of approximatey 70° with the horizontal, a primary work support surface for predominantly writing tasks placed at approximately 20° with the horizontal, and a geometric relationship between the secondary work support member and the primary work support surface to allow note taking during reading tasks.

In addition, I have found that when it is necessary to engage in sustained combination reading and writing tasks it is desirable that the secondary work support member should be movable to a second position more distant from the user wherein the secondary work support member will support reference materials for secondary or occasional reading but will not interfere with unrestricted use of the primary work surface. However, if the primary work surface and secondary work support member are properly lighted, movement of the secondary work support member would frequently cause lighting problems unless the inclination of the support member is adjusted.

The use of an inclined work surface is well known, as in the drafting table art. The use of raised work holders is also well known, as in work stands for holding copy in connection with typing tasks, and in music stands for holding music for musicians. Although limited attempts have been made to combine a book support or similar work holder with a desk, none have satisfactorily provided a combination of inclined primary work surface and secondary work support member which is both movable and provides a desirable change of inclination between forward reading positions and rearward secondary reference positions.

It is believed that my invention disclosed herein satisfies the conditions necessary for an adequate work environment relating to work surfaces in a manner that is heretofore unknown in the industry.

SUMMARY OF THE INVENTION

My new and improved desk top work support device includes a base having an inclined primary work surface upon which is pivotally mounted a secondary work support member that pivots to translate the position of the secondary work support member from a forward position directly over the primary work support surface to a rearward position substantially rearwardly displaced from the forward position. At the same time, the pivoting means changes the angle of the work support member with respect to the primary work surface.

The pivoting means comprises a pivotally connected four bar linkage which is a variation from the configuration of a parallelogram. With the top and bottom links unequal in length, the inclination of the secondary work support member which is connected to the top link changes as it is pivoted by the pivoting means from a preset forward to a preset rearward position. The preset forward position of the secondary work support member provides the user with a close reading surface which may preferably be inclined at approximately 70° to the horizontal. When the length of the top link is somewhat greater than the bottom link, the linkage provides the secondary work support member with a preset rearward position presenting a reading surface for secondary reference purposes which is inclined at approximately 50° to the horizontal, and which at the same time allows the operator full access to the inclined primary work surface for his writing task. Additionally, the operator's ability to select preset secondary work positions at said preferred inclinations of 70° and 50° eliminates glare problems when a light source is placed in a position which is optimum for illuminating the work surfaces, without requiring separate adjustment of the inclination of the support member by the operator at each separate position.

It is an object of the present invention to provide a desk top work support device of improved environmental design.

It is a further object of the present invention to provide a primary work surface and a rotatable secondary work support member to be used for sustained reading and/or writing tasks, separately or in combination.

An additional object of the present invention is to provide a desk top work support device which is highly portable and that can be used on any flat surface.

Other objects, features and advantages of my invention will be apparent from the following detailed description of the drawings wherein a preferred embodiment of the invention has been selected for exemplification.

DESCRIPTION OF THE PREFERRED EMBODIMENT

Figure 1:
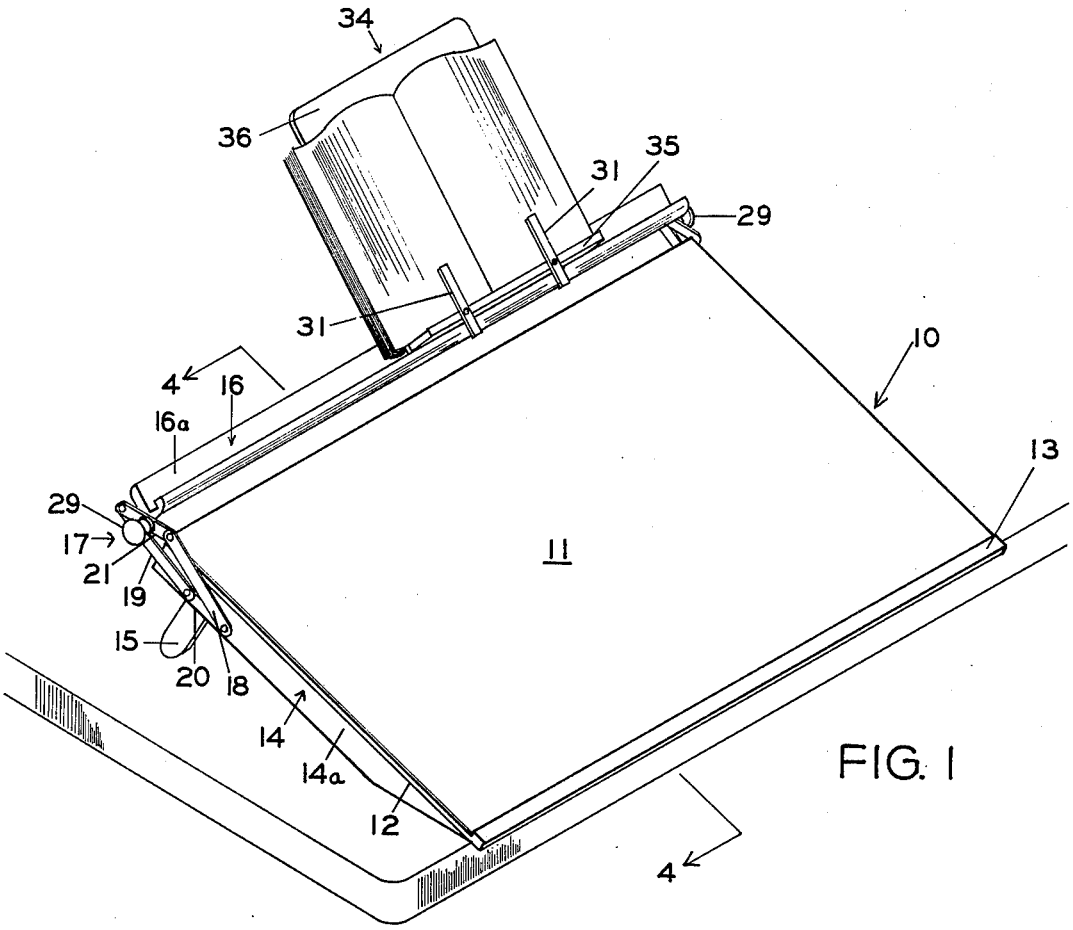
FIG. 1 is a perspective view showing my improved desk top work support device placed on a desk top.

Referring more particularly to the drawings, wherein like numerals refer to like parts throughout the several views, FIG. 1 illustrates a preferred embodiment of my desk top work support device, generally represented by reference number 10, which is shown portably mounted on a desk top. The illustrated work support device 10 has a base 14 which supports an inclined primary work surface 12. A conventional thin fixed or removable drawing surface 11 may preferably be retained on the inclined work surface 12 by a front lip 13 which projects upwardly along the lower edge of the surface 12.

Figure 3:
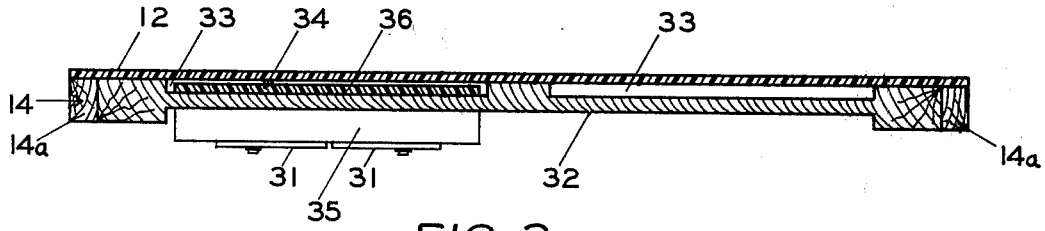
FIG. 3 is a section view taken along section line 3—3 of FIG. 2, in which one secondary work support holder is shown in a stored position.
Figure 4:
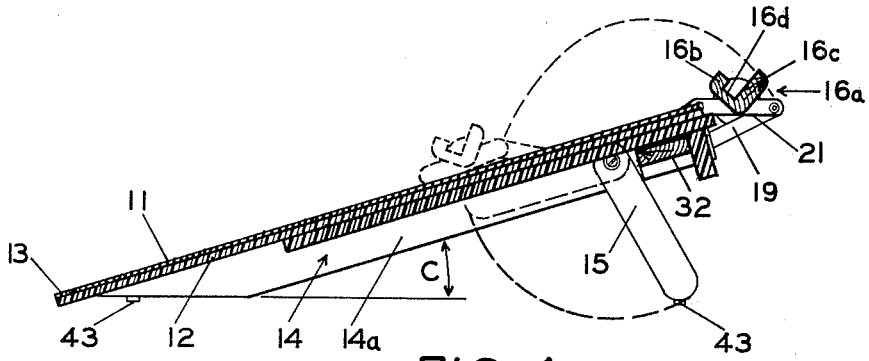
FIG. 4 is a section view taken along section line 4—4 of FIG. 1.

As best shown in FIG. 4 the primary work surface 12 is preferably supported at an angle C of approximately 20° with the horizontal by the base 14, which includes side rails **14*a* having rotatable rear legs 15. As best shown in FIGS. 3 and 4, the base 14 also includes a slotted rear storage bar 32 attached to and extending between the side rails 14*a*, which prevents further rearward rotation of the rear legs 15**.

The primary work surface 12 is attached to the top surface of the side rails **14*a* by any conventional means such as gluing, bolting, clamping, or by my preferred use of attachment screws (not shown). Similarly, the slotted rear storage bar 32 can be secured to the inner side surfaces of the side rails 14*a* by any suitable means, such as attachment screws 41, shown in FIG. 2. The rotatable rear legs 15 can be attached by any conventional means that will allow the legs to rotate more than 90°. The rear legs 15 in the preferred embodiment can then be rotated upwardly adjacent the side rails 14*a* for convenient storage or transit as shown by the dotted lines in FIG. 4. For added stability and to prevent scratching the surface upon which the desk top work support device is placed, rubber feet 43 have been attached to the bottom surface of the side rails 14*a* and the rear legs 15**.

Figure 2:
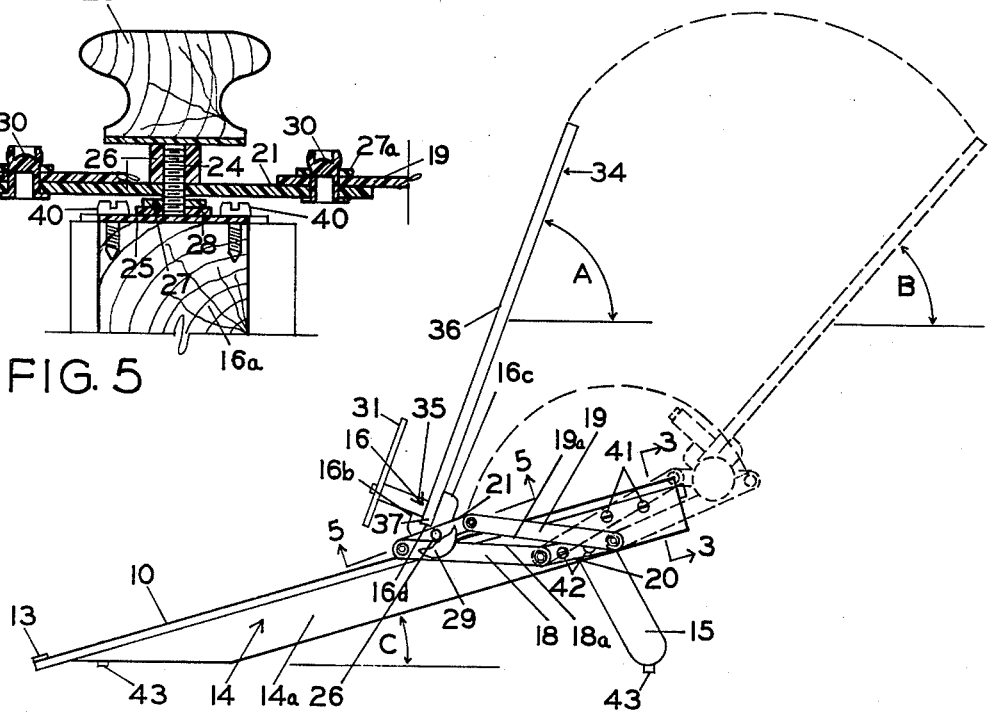
FIG. 2 is a side view of my work support device showing preset forward and rearward positions of the secondary work support member in full and dotted lines, respectively, and having a knob portion cut away for purposes of illustration.

A secondary work support member 16 suitable for holding books and other reference materials is pivotally mounted above the primary work surface 12 on a linkage represented generally by reference number 17. As best shown by FIGS. 3 and 4 the secondary work support member 16 is preferably of two parts, having a secondary work support bar **16*a* and an L-shaped secondary work support holder represented generally by reference number 34. As best shown by FIG. 2, the L-shaped secondary work support holder 34 has an upright plate 36, a lower arm 35, retaining arms 31 rotatably mounted on the front edge of the lower arm 35, and an extended lower section 37 which projects below the junction of the upright plate 36 and the lower arm 35. In FIG. 2, the knob 29** has been partially broken away for illustrative purposes.

As shown in FIG. 3 the secondary work support holders 34 can be slideably engaged in the slots 33 of the slotted rear storage bar 32 beneath the primary work surface 12 in a storage position. Only one secondary work support holder 34 is shown in such a storage position in FIG. 3 to better illustrate the structure and use of the slots 33. FIG. 4 illustrates that the secondary work support holders 34 are prevented from being withdrawn from the slots 33 by the secondary work support bar **16*a* when it is pivoted to its preset rearward position, as will be more fully described below. This storage and "locking" feature in conjunction with the folding of the rear legs 15** makes the illustrated preferred embodiment a compact and highly portable unit.

As best shown in FIG. 4, the secondary work support bar **16*a* has a J-shaped cross-section with a short front portion 16*b* and a longer rear portion 16*c* which in part define a longitudinal slot 16*d*. FIG. 2 shows the work support bar 16*a* removably engaging the work support holder 34 in the following manner. The extended lower section 37 is engaged within the longitudinal slot 16*d*. The rearside of the upright plate 36 bears against the longer support bar rear portion 16*c*. The lower portion of the front side of the upright plate 36 bears against the support bar front portion 16*b*. It is to be understood that the angular orientation of the slot 16*d* and the gravitational force on the inclined plate 36 assures retention of the work support holder 34 within the support bar 16*a***.

Figure 5:
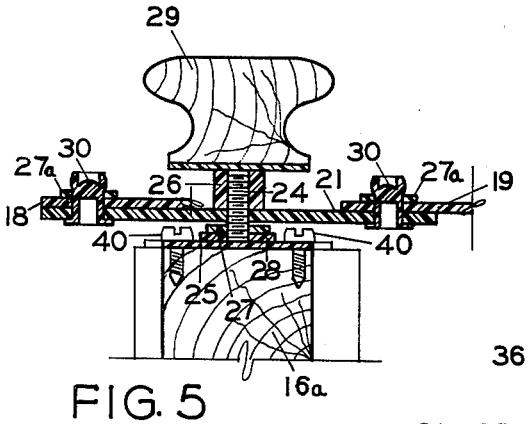
FIG. 5 is an enlarged partial section view taken along section line 5—5 of FIG. 2, in which the secondary work support bar is only partially shown.

The secondary work support bar **16*a* is connected to the top link 21 of the subsequently described linkage 17 in rotatably adjustable relation. The preferred adjustable connection is shown in FIG. 5, and consists of a threaded shaft 24 attached to a short link 25, which is in turn attached to the end of the work support bar 16*a* by conventional means such as the illustrated attachment screws 40. The threaded shaft 24 passes through a spacer washer 28, a bevelled washer 27, and the top link 21 intermediate the ends thereof. A threaded nut 26 is rotatably positioned over the threaded shaft 24 and is integrally connected to a knob 29, which facilitates tightening and loosening of the threaded nut 26 to permit selective adjustment of the angular inclination of the work surface secondary work support bar 16*a* on the linkage 17**.

The linkage 17 previously referred to preferably comprises a forward link 18, a rearward link 19, a bottom link 20, and a top link 21. The bottom link 20 is fixedly secured to the base 14 at the side rails **14*a* by conventional means such as the attachment screws 42 shown in FIG. 2. The linkage 17 has a preset forward position in which the secondary work support bar 16*a* extends across the primary work surface 12 near the mid-point thereof as shown in full lines in FIG. 2, and a preset rearward position in which the secondary work support bar 16*a* is located rearwardly from the primary work surface 12 to allow the operator full access to the primary work surface for writing tasks while supporting a reading surface for secondary reference purposes as represented in dotted lines in FIG. 2. It is also seen that the linkage 17 extends forwardly from the fixedly secured bottom link 20 while in its illustrated forward position, and extends rearwardly from link 20** when in its illustrated rearward position.

The preset forward and rearward positions are determined by the particular means used to limit the pivotal motion of the linkage 17. It is understood, for example, that such limiting means could be provided by placement of pins (not shown) on the side rails 14*a*. In the preferred embodiment, the top link 21 is connected to the inside surfaces of the forward and rearward links, as shown, and the illustrated forward and rearward positions are established when the threaded nut 26 which extends outwardly from the top link 21 engages the facing side edges 18*a* and 19*a* of the forward and rearward links, respectively, to prevent further pivotal rotation of the linkage 17. As shown in dotted lines in FIG. 4, the preset forward position preferably results in a clearance space between the secondary work support bar 16*a* and the primary work surface 12 adequate for placement of the writing surface 11 and the working papers.

The top link 21 is slightly longer than the bottom link 20 so that the linkage 17 is not a perfect parallelogram. As a result thereof, the angle of the top link 21 with respect to the horizontal decreases approximately 20° as the work support bar 16*a* is pivoted through a much larger angle such as 145° from its forward position to its rearward position. It is to be understood that the angle of the top link with respect to the horizontal can be decreased or increased as it pivots from its preset forward to rearward positions, depending on whether the top link 21 is longer or shorter than the bottom link 20, respectively.

Figure 6:
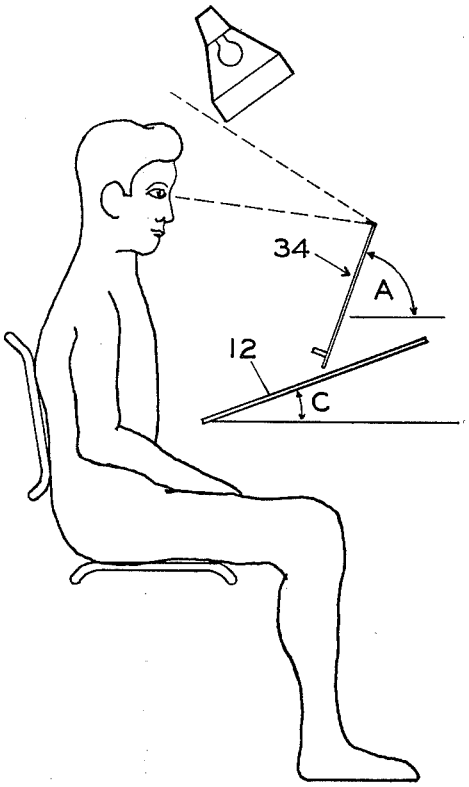
FIGS. 6 and 7 are side views showing an operator seated in front of schematically illustrated secondary work holders in the respective preferred forward and rearward positions provided by my improved desk top work support device.
Figure 7:
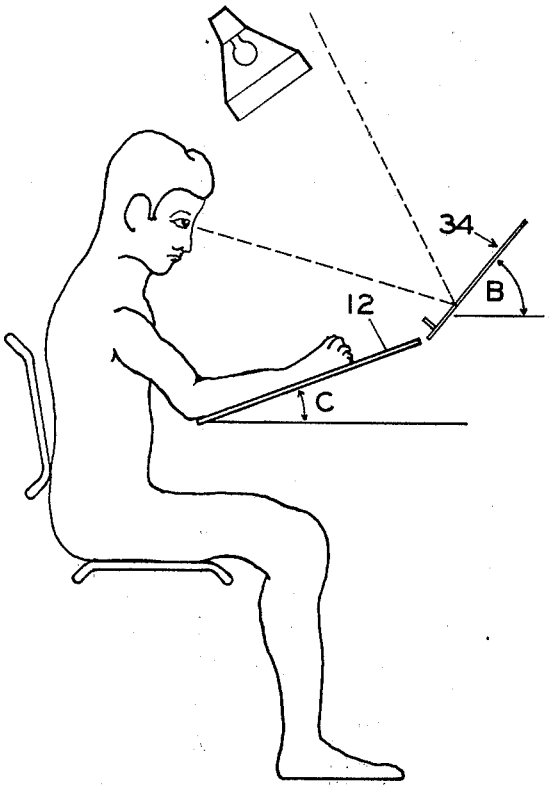

FIGS. 6 and 7 schematically illustrate the use of the work surfaces of my invention in relation to an optimum light source. FIG. 6 shows that when the primary work surface 12 is positioned at an inclination C equal to approximately 20° and the secondary work support holder 34 is positioned in its forward position at an inclination A equal to 70°, both angles with respect to the horizontal, the operator will not be distracted by direct reflection of light from either surface. FIG. 7 illustrates that when the secondary work holder has been pivoted to its preset rearward position at an inclination B equal to 50° with respect to the horizontal, the operator will again not be distracted by direct reflection of the light.

In accordance with the preceding description, the secondary work support bar 16*a* of my preferred embodiment is preferably adjustably connected to the top link 21 of linkage 17 so that the secondary work support holder 34 supported by the bar 16*a* is positioned at angles of 70° and 50° with respect to the horizontal when in the preset forward and rearward positions, respectively, as shown in FIG. 2. The foregoing describes the preferred inclinations for my device. However, the advantages of my device may be particularly obtained with a primary work surface inclination of from approximately 10° to 30°, and with a difference of inclination of the secondary work support member between its forward and rearward positions of up to approximately 30°, the range of 10° to 30° being most useful.

The preferred frictional connecting means used in the linkage 17 is shown in FIG. 5 to have a rivet 30 passing through holes in the end of the connected links which is expanded against a concave washer 27*a* to flatten the washer 27*a* against the adjacent link causing friction between the rivet, the washer and the links. Such friction enables an operator to rotate the linkage 17 to a stable position anywhere between the preset forward position and the preset rearward position in response to personal, job or lighting requirements.

It is to be understood that my desk top work support device 10 can be constructed of any suitable known materials. It is to be further understood that my invention is not confined to the particular construction and arrangement of parts herein illustrated and described, but embraces all such modified forms, and equivalents thereof, as come within the scope of the following claims.

I claim:

1. A desk top work support device comprising:

a. a base having an inclined primary work surface, b. a secondary work support member positioned above said primary work surface, and c. at least one linkage having a top link connected to said secondary work support member and having forward and rearward links pivotally connected to the said base and to said top link, said linkage and said connected secondary work support member being pivotable between a forward position in which the linkage extends forwardly from the base connection and the secondary work support member extends across the primary work surface to provide a close reading position and a rearward position in which the linkage extends rearwardly from the base connection and the secondary work support member is located rearwardly from the primary work surface to provide a secondary reference reading position and to allow full access to the primary work surface, d. the distance between the points of connection of the forward and rearward links to the top link being greater than the distance between the points of connection of the forward and rearward links to the base to position the secondary work support member at a greater inclination with respect to the primary work surface in its forward position than in its rearward position.

2. The desk top work support device specified in claim 1 wherein the distance between the linkage points of connection to the top link is sufficiently greater than the distance between the linkage points of connection to the base to cause the inclination of the secondary work support member to be approximately from 10° to 30° greater with respect to the horizontal in its forward position than in its rearward position.

3. The desk top work support device specified in claim 1 wherein the secondary work support member is secured to the top link in rotatably adjustable relation to permit adjustment of the inclination of said support member of the linkage.

4. The desk top work support device specified in claim 1 wherein the secondary work support member comprises:

a. a secondary work support bar; and b. at least one secondary work support holder removably engageable on said support bar.

5. The desk top work support device specified in claim 4 wherein:

a. the secondary work support holder has a downwardly projecting extended lower section, and b. the secondary work support bar has a longitudinal slot for removably engaging said extended lower section to support said work support holder on said work support bar.

6. A desk top work support device comprising:

a. a base having an inclined primary work surface, b. a secondary work support member positioned above said primary work surface, said secondary work support member including a secondary work support bar and at least one secondary work support holder removably engaged on said support bar, c. means attached to said base for pivoting said secondary work support member between forward and rearward positions having predetermined inclinations with respect to said primary work surface, the angular differrence between said inclinations of said secondary work support member being smaller than the angle through which said pivoting means pivots between said forward and rearward positions, and d. a slotted rear storage bar on said base having at least one slot for slidably receiving at least one secondary work support holder beneath the primary work surface in a storage position, the secondary work support bar being positioned to prevent slidable removal of said holder from said storage position when said work support bar is pivoted to its rearward position.

7. A desk top work support device comprising:

a. a base having an inclined primary work surface, b. at least one linkage having a top link and having forward and rearward links pivotably connected to the said base and to said top link, said linkage being pivotable between forward and rearward working positions, the distance between the points of connection of the forward and rearward links to the top link being greater than the distance between the points of connection of the forward and rearward links to the base to position the secondary work support member at a greater inclination with respect to the primary work surface in its forward position than in its rearward position, and c. a secondary work support member positioned above said primary work surface and adjustably secured to the top link to permit adjustment of the angular inclination of the said secondary work support member with respect to the linkage.

8. A desk top work support device comprising:

a. a base having an inclined primary work surface, b. a secondary work support member positioned above said primary work support surface, and c. at least one linkage having a top link connected to said secondary work support member and having forward and rearward links pivotably connected to the said base and to said top link, said linkage and said connected secondary work support member being pivotable between forward and rearward working positions, d. said linkage including at least one frictional connection means comprising a rivet passing through a concave washer and holes in the ends of adjacent pivotally connected links, said rivet being expanded to flatten said washer against an adjacent link and provide a frictional connection for retaining the linkage and the secondary work support member in any position between their forward and rearward positions.

* * * * *